United States Patent [19]

Glasser

[11] 4,177,823

[45] Dec. 11, 1979

[54] COMBINATION KEY RING

[76] Inventor: Michael Glasser, 5444 Sepulveda #221, Van Nuys, Calif. 91401

[21] Appl. No.: 839,827

[22] Filed: Oct. 6, 1977

[51] Int. Cl.[2] ..... A24F 9/02; A24F 9/04

[52] U.S. Cl. ..... 131/184 R; 131/243; 131/247

[58] Field of Search ..... 131/184, 247, 243, 245, 131/246

[56] References Cited

U.S. PATENT DOCUMENTS

| | | | |
|---|---|---|---|
| 991,278 | 5/1911 | Cook | 131/247 |
| 2,314,393 | 3/1943 | Dougherty | 131/247 X |
| 3,672,374 | 6/1972 | Mancuso | 131/243 |

FOREIGN PATENT DOCUMENTS

| | | | |
|---|---|---|---|
| 530777 | of 1955 | Italy | 131/247 |
| 7291 | of 1899 | United Kingdom | 131/847 |

*Primary Examiner*—Stephen C. Pellegrino

[57] ABSTRACT

Herein described is a combination key ring and smoker's tool which includes a cylindrical body which has a plunger protruding from one end of the body. By manipulation, the plunger extends outwardly from the body and can be used for packing a pipe bowl with tobacco. It can also be used as a device for holding cigarettes. An end clip is connected between the plunger and the body and has a downwardly depending knife-like edge to be used as a pipe scraper. Rings are attached to the clip in the end of the plunger device and can be attached to the smoking tool.

6 Claims, 4 Drawing Figures

Fig. 1
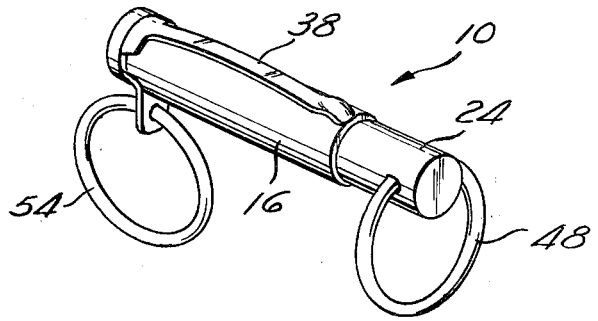
Fig. 2
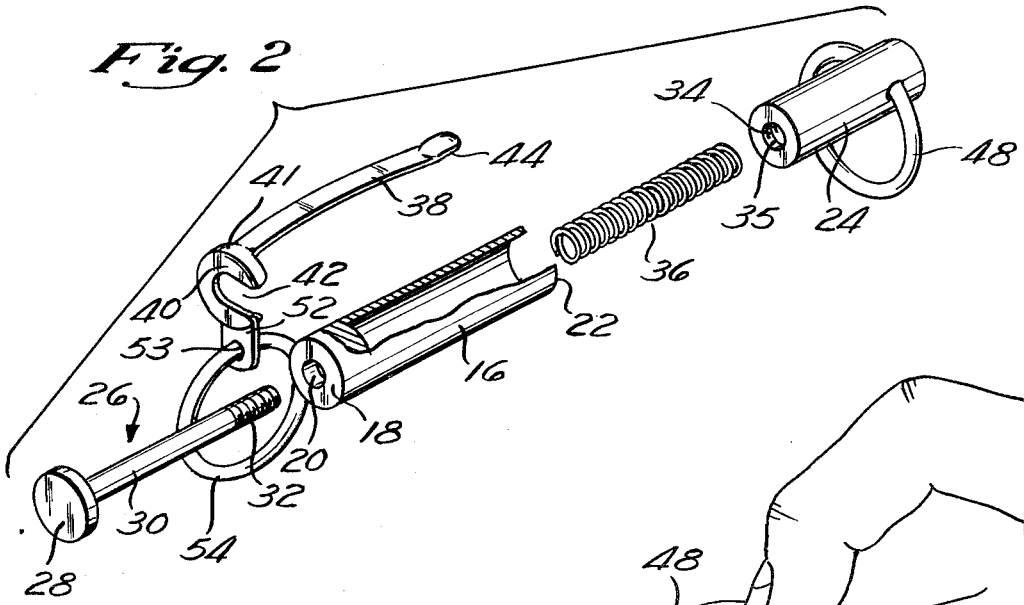
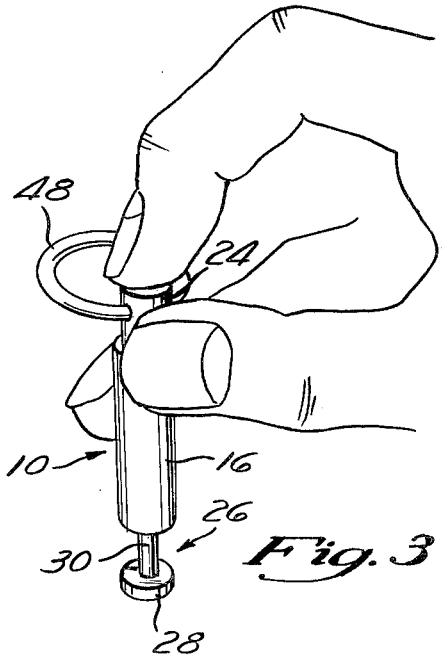
Fig. 3
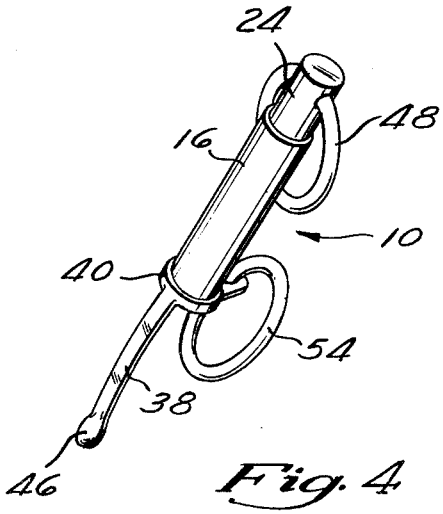
Fig. 4

COMBINATION KEY RING

BACKGROUND

This invention relates to combination devices and more particularly to a combination key ring and a smoker's tool or the like which can be readily carried by the smoker in the pocket or purse.

In many instances, a smoker has need of special tools, such as a tool for packing pipe tobacco into place or a tool for scraping burnt, dry tobacco which has dried upon the inside of a pipe bowl or the like. Thus, special tools of this type are preferred by the smoker. In some instances, smokers carry a knife for the purpose of scraping the pipe bowl and a tool for tamping the tobacco into place. At times, a tobacco user uses tobacco without actually smoking it. This type of tobacco is referred to as snuff. Snuff is used by the tobacco user by taking small pinches of snuff, placing it at the nose and sniffing the tobacco into one's nostrils. Sometimes, the tobacco user prefers to do this with a small spoon-like tool which can then be placed into the nose without the necessity of touching the tobacco with one's fingers.

Also, there are times when a cigarette smoker, for example, would prefer not to hold a cigarette in one's hand, but rather by a tool.

The present invention provides a tool which provides all the desired uses as heretofore set forth and yet also can be attached as a key ring for the purpose of holding one's keys.

SUMMARY

Briefly described, the present invention provides an elongated cylindrical body which is hollow and has a large opening on one end and a small opening on the other which defines an inner ridge. A plunger, comprising a flat portion and an elongated cylindrical pin, is inserted into the small opening of the body and is attached to a core on the other end. The core and plunger is slidable within the body. A spring is placed within the body and bears against the inner ridge and against the core so that the plunger is always urged with the flat portion thereof against the end of the body. By depressing the core member, the plunger is moved outwardly.

An end clip is provided which includes a relatively thin, flat portion having a slot therein which fits between the end of the plunger and the end of the body. The slot surrounds the small cylindrical pin of the plunger. The clip includes an elongated knife-like tool which is coupled to the thin portion at right angles and has a spoon-shaped portion on the lower end thereof. The clip can be removed by depressing the plunger. It is then turned and replaced so that the knife-like end extends upwardly from the plunger and the end can be used as the device for scraping the inside of the pipe or for the purpose of the spoon-like end to be used for snuff or the like.

A ring is then adapted to be placed on the core end for holding keys. Another ring may be placed on the clip end to hold keys. This latter ring can be removed by removing the clip end thus the keys on this ring can be divided from the other keys.

By removing the clip, a plunger can be used to tamp the tobacco into a pipe or can used to hold an end of a cigarette by clipping it onto the side of the cigarette.

DESCRIPTION OF THE DRAWINGS

These and other features and advantages will become more apparent to those skilled in the art when taking into consideration the following detailed drawings wherein like reference numerals indicate like and corresponding parts throughout the several views and wherein:

FIG. 1 is a perspective view of the device hereinafter described fully assembled;

FIG. 2 is an exploded view of the device set forth in FIG. 1, illustrating all the parts therein;

FIG. 3 is a side view of the device set forth in FIG. 1 as is being operated by a tobacco user;

FIG. 4 is a perspective view of the device set forth in FIG. 1 with the end clip in its reversed position.

DESCRIPTION OF THE SHOWN EMBODIMENT

Referring now to FIG. 1, there is shown the assembly 10 as it is in its present assembled position and including a pair of key rings 12 and 14. The device can include keys, (not shown) attached to the rings 12 and 14 and easily carried in one's pocket.

Referring now to FIG. 2, there is shown in the exploded view of the present invention, a main body 16 which is hollow therethrough and has a substantially closed end 18 with a smaller opening 20 in the closed end 18. The other end 22 of the body 16 has a substantially larger opening, a core 24 is provided and is substantially cylindrical and has an outside diameter somewhat less than the inside diameter of the hollow portion of body 18 and is slidable into the body portion 16.

A plunger member 26 has a relatively flat top portion 28 and is round to match the cylindrical shape of the body portion 16. A centered pin 30 extends from the flat top portion 28 and is threaded at the end 32. Matching threads 34 are provided into an opening 35 in the core member 24. A coil spring 36 is placed within the hollow center of the body 16 and surrounds pin 30 of the plunger 26. The threads 32 of pin 30 threadably engaged the threads 34 of the core 24. Thus, by depressing the core 24 as shown in FIG. 3, the plunger 26 then extends outward from the body 16.

Still referring to FIG. 2, an end clip 38 has a relatively flat portion 40 thereon which is round in shape to match the shape of the core 16 and flat end portion 28 of the plunger 26. A slot 42 is shaped into flat end portion 26. The flat portion 40 is adapted to be placed between the closed end 18 of the main body 16 and the flat portion 28 of the plunger 26. The slot 42 surrounds the pin 30 and will be held in place until such time as the core 24 is again depressed, moving the plunger 26 downward from the body 16. At this position, the end clip can be removed or replaced as necessary. A downwardly depending skirt 41 extends from the flat portion 40 to fit snugly around either the end 18 of core 16 or the flat portion 28 so that the end clip 38 is held rigidly in place. A knife-like extended member 44 is coupled to the flat portion 40 and extends at right angles thereto and may include a spoon-like end 46 as best shown in FIG. 4.

It is possible to remove the clip member 38, turn it over so that the knife-like member 44 extends outwardly from the body portion 16 and be replaced between the plunger 26 and the body portion 16 so that it can be used as a knife edge in scraping a pipe or the spoon-shaped end can be used for snuff.

A key ring 48 can be placed through an opening 50 on the core member 24 for the purpose of holding keys. A ring tab 52 may be attached to the flat portion 40 of the end clip 38 and have a key ring 54 attached through an opening 53 in the ring tab 52 for holding keys on the opposite end of the assembly 10.

It is now possible that certain keys can be readily removed from the entire key ring by the removing of the clip 38 in the manner heretofore described. This makes it possible for someone to remove, for example, the car keys by having them attached to the clip and still keep the remainder of the keys on a different ring.

Thus what has been described herein is a handy, useful smoker's tool which is coupled in combination with a key ring that one can carry easily in a pocket or a purse. The assembly can be made of any type of material, such as plastic, or metal. It can be of molded material or it can be machined whichever is the most desireable. The device can be made in any desired colour. Many modifications are comtemplated and can be made and still remain in the spirit and scope of the invention which is only defined by the attached claims.

Having thus described but one preferred embodiment of this invention, what is claimed is:

1. In combination:

An elongated body being substantially hollow having a first end with an opening therein and a second end being substantially closed with a relatively smaller center opening therein, whereby the substantially closed end defining an inner ridge with said body near the second end thereof;

an elongated pin having a first end adapted to be disposed within the center opening in the second end of said body and a second end disposed from center opening outside of said body;

a substantially flat portion being coupled to the second end of said elongated pin and adapted to be disposed outside of the second end of said body;

an inner core member being adapted to be slidably inserted within the first end of said body and coupled to the first end of said elongated pin;

biasing means disposed between the inner ridge in said body and said core member for urging said core member and said elongated pin away from said body and for maintaining said flat portion on said pin against the second end of said body whereby pressure exerted against said core member forces said flat portion on said pin away from said body and defines a space therebetween;

an end clip having a relatively thin, flat member with a slot therein adapted to be placed between said flat portion and the first end of said body whereby said pin is fitted into said slot; and an elongated flat member coupled to said thin, flat member at a right angle thereto, whereby said end clip can be removed when said core member is depressed into said body.

2. The combination defined in claim 1 wherein said biasing means being a coil spring disposed around said pin having a first end against the inner ridge of said body and a second end against said inner core member.

3. The combination defined in claim 1 wherein said elongated body, said flat portion and said inner core member being substantially cylindrical in shape.

4. The combination defined in claim 3 wherein said pin being substantially cylindrical in shape and being threadably coupled to said inner core member.

5. The combination as defined in claim 1 and further including:

a concave depressed portion in said elongated flat member on the end opposite said relatively thin, flat portion.

6. The combination as defined in claim 1 and further including:

a first ring attached to said end clip and a second ring attached to said core member.

* * * * *